US008409494B2

(12) United States Patent
Ki et al.

(10) Patent No.: US 8,409,494 B2
(45) Date of Patent: Apr. 2, 2013

(54) SLAG DISCHARGE DOOR APPARATUS FOR ELECTRIC FURNACE

(75) Inventors: Joonseong Ki, Incheon (KR); Jinill Hwang, Incheon (KR)

(73) Assignee: Hyundai Steel Company, Incheon (KR)

( * ) Notice: Subject to any disclaimer, the term of this patent is extended or adjusted under 35 U.S.C. 154(b) by 0 days.

(21) Appl. No.: 13/311,424

(22) Filed: Dec. 5, 2011

(65) Prior Publication Data

US 2012/0139170 A1 Jun. 7, 2012

Related U.S. Application Data

(63) Continuation of application No. PCT/KR2010/004137, filed on Jun. 25, 2010.

(30) Foreign Application Priority Data

Dec. 29, 2009 (KR) ..... 10-2009-0132882

(51) Int. Cl.
*F27D 3/00* (2006.01)

(52) U.S. Cl. ..... 266/230; 266/227; 432/237

(58) Field of Classification Search ..... 266/227, 266/230, 271; 373/74; 432/237
See application file for complete search history.

(56) References Cited

U.S. PATENT DOCUMENTS 2,202,362 A * 5/1940 Weisgerber ..... 373/74
4,483,709 A * 11/1984 Schempp et al. ..... 75/10.42

FOREIGN PATENT DOCUMENTS

JP 07-145420 A 6/1995
JP 09-133475 A 5/1997
WO 2007-147248 A1 12/2007

OTHER PUBLICATIONS

English language translation of JP 09-133475, May 1997.*

* cited by examiner

*Primary Examiner* — Scott Kastler
(74) *Attorney, Agent, or Firm* — Knobbe Martens Olson & Bear, LLP

(57) ABSTRACT

A slag discharge door apparatus for an electric furnace is disclosed. The apparatus includes a door which is operated by a door operator to open or close a slag discharge outlet of the electric furnace, and a door support which supports the door in such a way that a portion of a lower end of the door overlaps with the door support, so that slag is inhibited from leaking out of the electric furnace through the slag discharge outlet.

13 Claims, 7 Drawing Sheets

SLAG DISCHARGE DOOR APPARATUS FOR ELECTRIC FURNACE

RELATED APPLICATION

This application is a continuation application under 35 U.S.C. §365(c) of International Application No. PCT/KR2010/004137, filed Jun. 25, 2010 designating the United States. This application further claims the benefit of the earlier filing date under 35 U.S.C. §365(b) of Korean Patent Application No. 10-2009-0132882 filed Dec. 29, 2009. This application incorporates herein by reference the International Application No. PCT/KR2010/004137 and the Korean Patent Application No. 10-2009-0132882 in their entirety.

TECHNICAL FIELD

The present disclosure relates generally to an electric furnace, and more particularly, a slag discharge door structure of an electric furnace.

BACKGROUND ART

Generally, electric furnaces heat and melt metal or alloys using electric energy. In such an electric furnace, scraps are inserted into the furnace and then arc currents are applied between three electrodes and the scraps, thus heating the scraps to melt them.

Slag is formed on an upper surface of molten steel in the electric furnace by oxidation of impurities contained in the scraps.

The slag isolates the molten steel in the electric furnace from the air, thus retaining arc-generating heat, and preventing the molten steel from adsorbing impurities contained in the air.

The slag functions to enhance the power efficiency of the furnace and to improve the quality of the steel.

SUMMARY

An aspect of the present invention is to provide a slag discharge door apparatus for an electric furnace which is configured inhibit slag from leaking out of the electric furnace when steelmaking.

Embodiments of the present invention provides a slag discharge door apparatus for an electric furnace, including: a door opening and closing a slag discharge outlet of the electric furnace; a door support disposed so that a portion of a lower end of the door overlaps with the door support; and a door operator operating the door to open or close the slag discharge outlet, wherein a stepped portion protrudes from the door support such that the lower end of the door overlaps with the stepped portion.

A slag discharge door apparatus for an electric furnace according to embodiments of the present invention inhibit slag from leaking out of the electric furnace during steelmaking, thus improving the heat efficiency during arc discharge.

Embodiments of the present invention enhance the quality of steel manufactured by the electric furnace.

Embodiments of the present invention increase a return rate of recyclable valuable metal oxides from slag to enhance cost effectiveness.

| | |
|---|---|
| 10: door | 11: coolant passages for door |
| 20: door support | 21: support base portion |
| 22: stepped portion | 23: first coolant passages for door support |
| 24: second coolant passages for door support | 30: door operator |
| 31: door lift device | 40: guide rail |
| 41: coolant passages for guide rail | 50: solidified slag detaching unit |
| 51: support vibrating motor | 52: solidified slag removal protrusions |
| 53: protrusion drive device | 54: stepped portion drive device |
| 60: solidified slag detaching unit | 61: rail vibrating motor |
| 62: solidified slag removal pin | 63: pin drive device |

EMBODIMENTS

Figure 1:
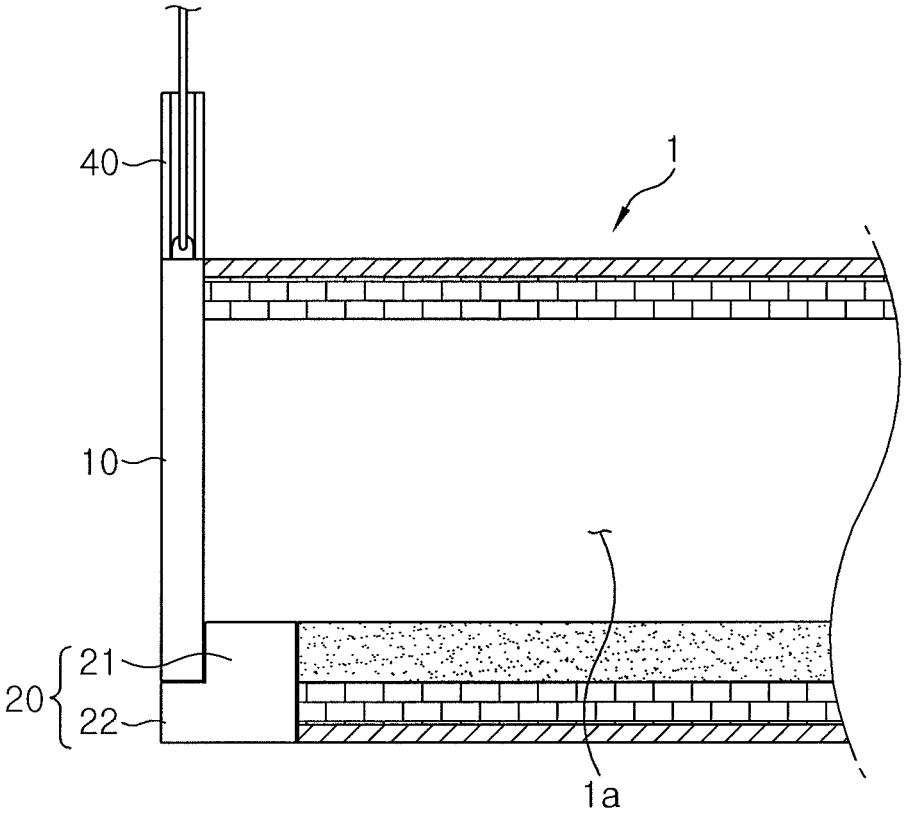
FIG. 1 is a schematic view of a slag discharge door apparatus for an electric furnace according to embodiments of the present invention
Figure 2:
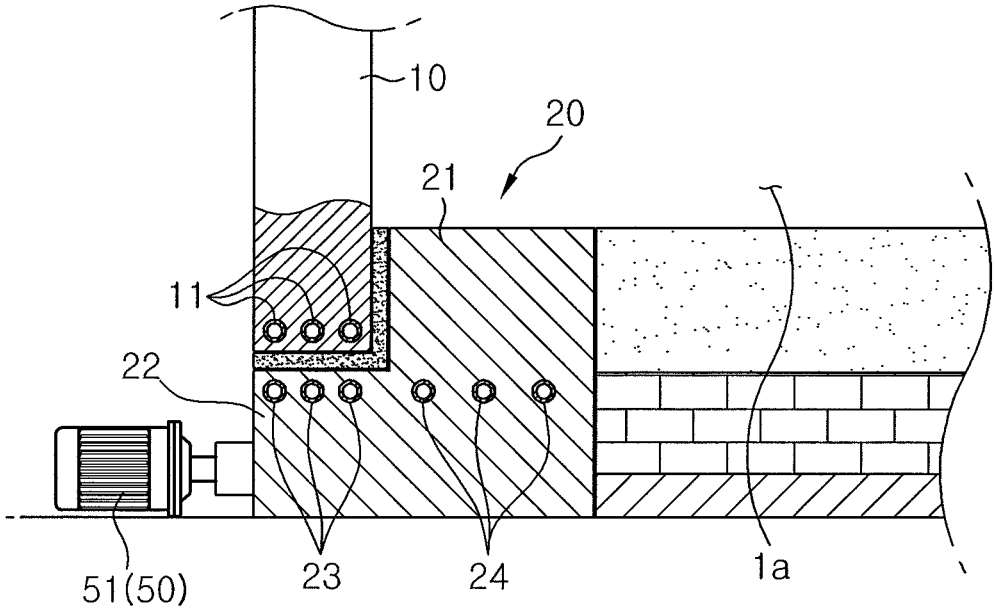
FIG. 2 is a sectional view showing an embodiment of the present invention.

As shown in FIGS. 1 and 2, an electric furnace 1 has at a predetermined position thereof a slag discharge outlet 1*a* through which slag is discharged from the electric furnace 1.

Slag is a by-product resulting from oxidation of impurities contained in scraps in the electric furnace 1 during steelmaking.

The slag isolates molten steel in the electric furnace 1 from the air, thus retaining arc-generating heat, and preventing the molten steel from adsorbing impurities contained in the air.

In embodiments of the present invention, a door 10 opens and closes the slag discharge outlet 1*a* to control discharge of slag.

A door support 20 is provided in an end of the slag discharge outlet 1*a*. A portion of a lower end of the door 10 overlaps with the door support 20.

A stepped portion 22 is formed at one side of the door support 20 so that the door support 20 has a depressed shape. The stepped portion 22 supports a lower surface of the lower end of the door 10.

In detail, the door support 20 includes a support base portion 21 with which the lower end of the door 10 partially overlaps, and the stepped portion 22 which protrudes from one side of the support base portion 21 with a height difference between the stepped portion 22 and the support base portion 21, which provides a recessed portion and supports the lower end of the door 10.

The door support 20 includes first coolant passages 23, which are located in the stepped portion 22 to cool an upper surface of the stepped portion 22, and second coolant passages 24 which cool the door support 20 to protect it from being deformed by high heat of slag.

The cooling is performed by circulating cooling water through the first coolant passages 23 and the second coolant passages 24.

The door support 20 is made of metal that is resistant to high heat. The door support 20 is cooled by the cooling water circulating through the second coolant passages 24 so that when slag is discharged out of the slag discharge outlet 1*a*, the door support 20 is protected from being deformed by high heat of the slag.

Furthermore, cooling water flowing through the first coolant passages 23 cools the upper surface of the stepped portion 22 so that slag that leaks through a gap formed between the upper surface of the stepped portion 22 and the lower end of the door 10 is cooled and solidified.

The door 10 has coolant passages 11 in the portion thereof that overlaps with the door support 20.

Cooling water circulates through the coolant passages 11 to cool the lower end of the door 10 so that slag that leaks through the gap formed between the upper surface of the stepped portion 22 and the lower end of the door 10 is cooled and solidified.

Slag that is formed on the surface of molten steel in the electric furnace 1 during steelmaking expands in volume during carburization in oxidation refining. The expanded slag is drawn into the slag discharge outlet 1*a*.

The initial slag formed by expanding in volume during the oxidation refining process contains a large amount of valuable metal oxides, such as iron oxide (FeO) and is characterized by very high fluidity.

While the initial slag is formed, the door 10 closes the slag discharge outlet 1*a* to prevent the initial expanded slag from being discharged.

However, because the fluidity of the initial slag is very high, it may leak even through tiny gaps around the door 10 and the slag discharge outlet 1*a*.

In embodiments of the present invention, the door 10 is configured so that the lower end thereof partially overlaps with the corresponding surface of the door support 20.

Furthermore, the door 10 is configured in such a way that the lower end thereof overlaps the upper surface of the stepped portion 22, so that slag is additionally prevented from leaking.

In addition, the lower end of the door 10 is seated and supported on the upper surface of the stepped portion 22 so that a gap between the door 10 and the stepped portion 22 is minimized.

As stated above, the fluidity of the initial slag is very high; sufficient to leak even through tiny gaps between the door 10 and the door support 20.

In embodiments of the present invention, the initial slag that is in the gap between the door 10 and the door support 20 is cooled and solidified by the cooling water that circulates through the coolant passages 11 and the first coolant passages 23.

Therefore, the gap between door 10 and the door support 20 is completely sealed by the solidified slag, so that slag is reliably prevented from leaking out of electric furnace 1 through the gap.

Meanwhile, the door 10 is operated by a door operator 30 to open or close the slag discharge outlet 1*a* of the electric furnace 1.

Figure 3:
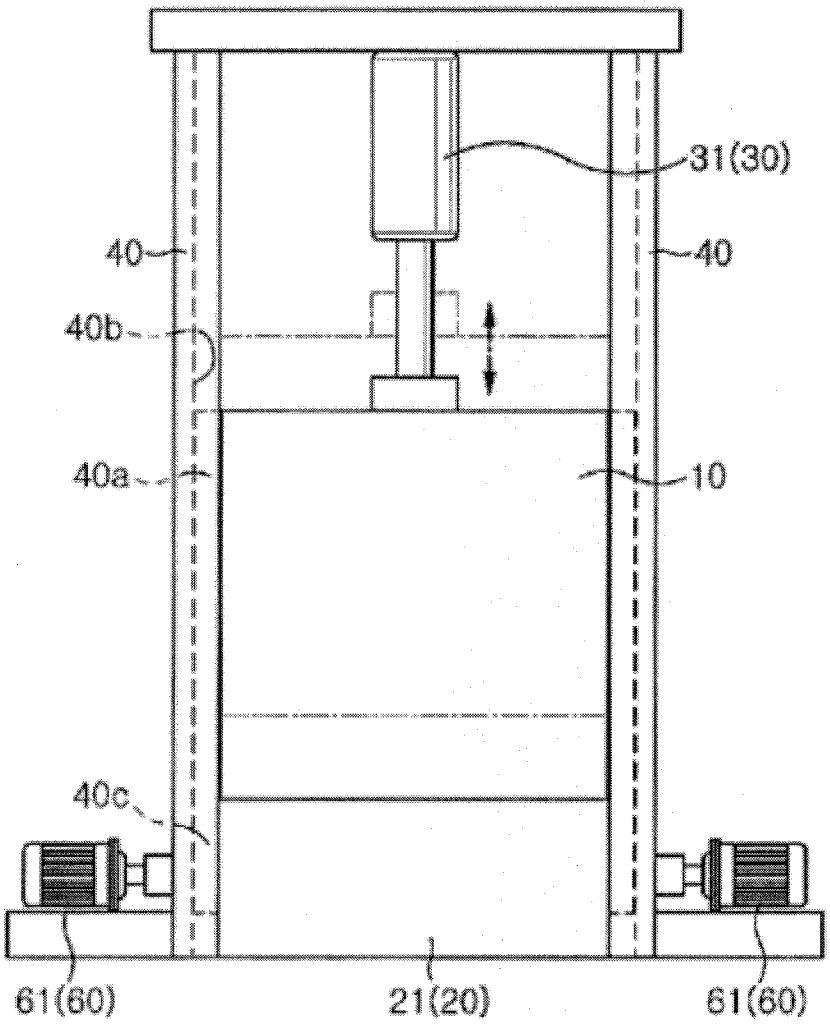
FIG. 3 is a front view showing the embodiment of the present invention.

As shown in FIG. 3, in the embodiment, the door operator 30 may comprise a door lift device 31 which moves the door 10 upwards or downwards to open or close the slag discharge outlet 1*a*.

Alternatively, the door operator 30 may comprise a door rotating device which rotates the door 10 to open or close the slag discharge outlet 1*a* of the electric furnace 1, although it is not shown in the drawings.

As a further alternative, the door operator 30 may comprise a door sliding device which horizontally slides the door 10 to open or close the slag discharge outlet 1*a* of the electric furnace 1. As such, it will be understood that a variety of modifications of the embodiment of door operator 30 are possible.

In the embodiment, the door lift device 31 comprises a hydraulic cylinder or pneumatic cylinder which is coupled to an upper end of the door 10.

In detail, a piston rod of the hydraulic cylinder or pneumatic cylinder is coupled to the upper end of the door 10.

The piston rod is actuated by controlling hydraulic pressure applied into the hydraulic cylinder, thus moving the door 10 upwards or downwards.

When the door 10 is moved upwards or downwards by the hydraulic cylinder, the slag discharge outlet 1*a* is opened or closed.

Preferably, embodiments of the present invention further include guide rails 40 which guide the door 10 when it moves to open or close the slag discharge outlet 1*a*.

Figure 4:
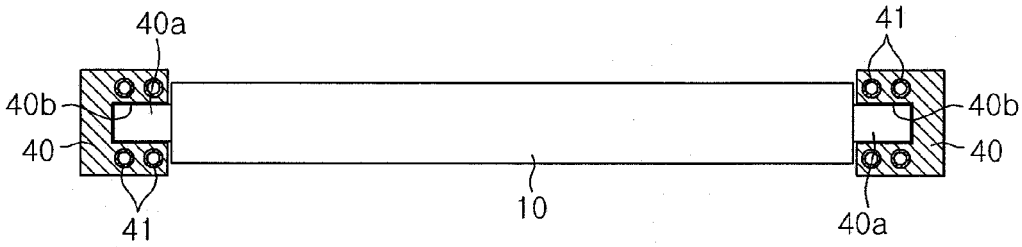
FIG. 4 is a plan sectional view showing the embodiment of the present invention.

As shown in FIG. 4, the guide rails 40 are placed upright on opposite sides of the door 10. Guide grooves 40*b* are formed in respective guide rails 40 in the longitudinal directions thereof so that guide protrusions 40*a* provided on the respective opposite side edges of the door 10 are inserted into the corresponding guide grooves 40*b*.

Furthermore, in the embodiment, the guide grooves 40*b* are formed in the guide rails 40 in the same direction as the direction in which the door 10 moves. The guide protrusions 40*a* which are inserted into the corresponding guide grooves 40*b* are provided on the opposite side edges of the door 10.

In addition, each guide protrusion 40*a* includes a groove cover protrusion 40*c* which extends a predetermined length from the door 10 downwards and is inserted in the corresponding guide groove 40*b* of the guide rail 40.

The groove cover protrusions 40*c* of the guide protrusions 40*a* move with being placed in the corresponding guide grooves 40*b* to cover the guide grooves 40*b* that communicate with the slag discharge outlet 1*a* when the slag discharge outlet 1*a* is open.

In other words, the groove cover protrusions 40*c* cover portions of the corresponding guide grooves 40*b* that are exposed by opening the slag discharge outlet la, and this prevent the slag from filling the guide grooves 40*b*.

Meanwhile, the embodiment may be modified in such a way that guide grooves 40*b* are formed on the opposite side edges of the door 10, and that guide protrusions 40*a* which are inserted into the corresponding guide grooves 40*b* are provided on the guide rails 40 that are placed upright on opposite sides of the door 10.

Furthermore, such a door guide structure can be modified into any structure which is disposed in the direction in which the door 10 moves, that is, in the direction in which the door 10 is operated to open or close the slag discharge outlet 1*a*, so long as it can correctly guide the movement of the door 10.

Preferably, coolant passages 41 are provided in each guide rail 40.

Cooling water circulates through the coolant passages 41 to cool the guide rail 40.

The guide rail 40 is cooled by the cooling water that circulates the coolant passages 41, thus the guide rail 40 is protected from being deformed by high heat of slag that is discharged from the electric furnace 1 through the slag discharge outlet 1*a*.

Furthermore, the coolant passages 41 functions to solidify slag which is adhered to the guide rail 40 while slag is discharged through the slag discharge outlet 1*a*, and thus, it is easy to remove the adhered slag from the guide rail 40.

Meanwhile, preferably, embodiments of the present invention further include a solidified slag detaching unit 50 which detaches solidified slag from the upper surface of the door support 20.

Solidified slag formed by solidification of slag on the upper surface of the door support 20 causes a problem of forming a gap between the door 10 and the door support 20 when the door 10 which has been open is closed. Hence, after the door 10 has been open, such solidified slag must be eliminated.

The solidified slag, while being solidified, is adhered to the upper surface of the door support 20, that is, the upper surface of the stepped portion and side surfaces of the door support 20. Thus, it is not easy for a worker to remove the base metal.

The solidified slag detaching unit 50 is operated to detach the solidified slag from the upper surface of the door support 20, and thus makes it easy for the worker to eliminate the solidified base metal.

In an embodiment, the solidified slag detaching unit 50 may comprise a support vibrating motor 51 which is connected to the door support 20 and vibrates the door support 20.

The support vibrating motor 51 vibrates the door support 20 to remove solidified slag on the upper surface of the door support 20 from the door support 20.

Figure 5:
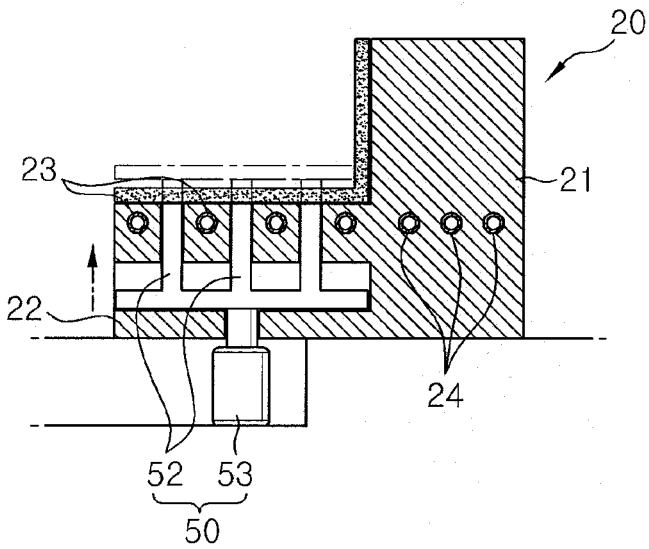
FIG. 5 is a view showing the operation of another embodiment of the present invention.

In another embodiment, as shown in FIG. 5, the solidified slag detaching unit 50 includes a plurality of solidified slag removal protrusions 52 which are placed through the stepped portion 22 so as to be movable upwards and downwards and thus extracted from and retracted into the upper surface of the stepped portion 22, and a protrusion drive device 53 which moves the solidified slag removal protrusions 52 upwards and downwards.

For example, the protrusion drive device 53 may comprise a hydraulic cylinder. In addition to this, the structure of the protrusion drive device 53 can be variously modified as long as it can move the solidified slag removal protrusions 52 upwards and downwards.

The solidified slag removal protrusions 52 are extracted upwards from the upper surface of the stepped portion 22 of the door support 20 by the operation of the protrusion drive device 53, that is, the hydraulic cylinder, thus detaching solidified slag from the upper surface of the stepped portion 22.

Figure 6:
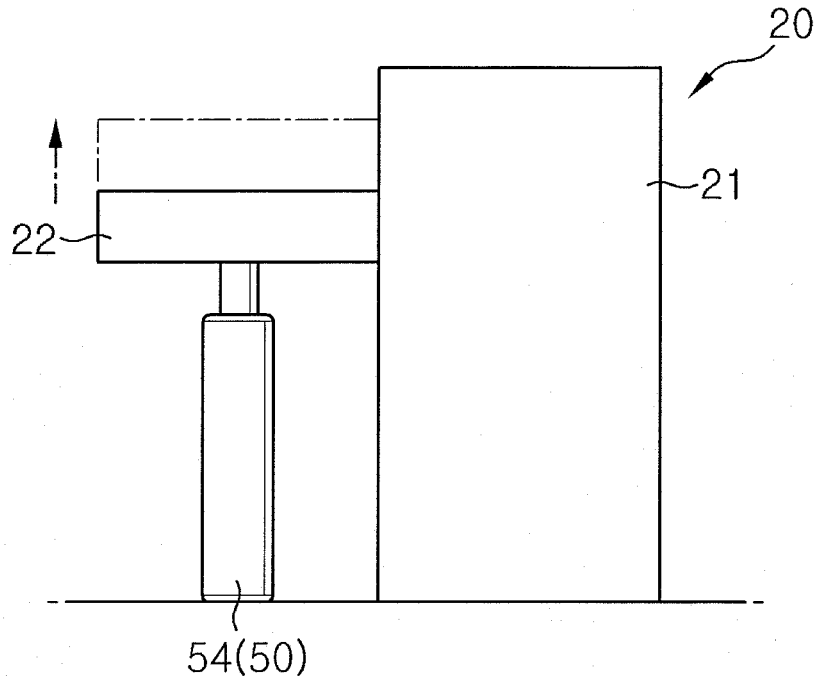
FIGS. 6 and 7 are views showing the operation of another embodiment of the present invention.
Figure 7:
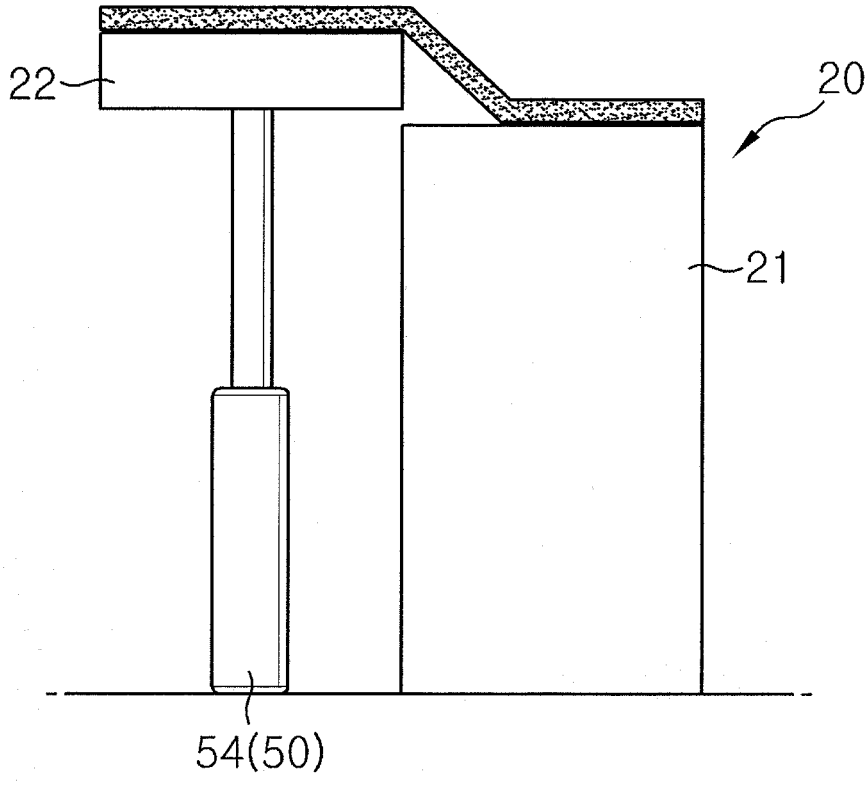

In another embodiment, as shown in FIGS. 6 and 7, a door support 20 may include a support base portion 21 with which the lower end of the door 10 partially overlaps, and a stepped portion 22 which is provided on a side surface of the support base portion 21 so as to be movable upwards and downwards and supports the lower end of the door 10.

Furthermore, in this embodiment, the solidified slag detaching unit 50 may include a stepped portion drive device 54 which moves the stepped portion 22 upwards and downwards.

The stepped portion drive device 54 moves the stepped portion 22 upwards and downwards while the stepped portion 22 is in close contact with the side surface of the support base portion, so that solidified slag which has been adhered to the upper surface of the stepped portion 22 and solidified slag which has been adhered to the side surface of the support base portion 21 are detached therefrom by impacts generated when the stepped portion 22 moves upwards and downwards.

In the embodiment, although the stepped portion drive device 54 is illustrated as comprising a hydraulic cylinder, any device can be used as the stepped portion drive device 54 so long as it can move the stepped portion 22 upwards and downwards.

Preferably, the stepped portion drive device 54 can moves the stepped portion 22 upwards to a height equal to or higher than the upper surface of the support base portion 21.

The reason for this is to facilitate removal of solidified slag which is between the door 10 and the door support 20

Furthermore, the solidified slag detaching unit 50 further includes an operation controller which is connected to the door operator 30 and the stepped portion drive device 54 so that when the slag discharge outlet 1*a* is open or closed, the stepped portion 22 automatically moves upwards or downwards under the control of the operation controller.

The operation controller is operated in such a way that when the door 10 is lifted, the stepped portion 22 is moved upwards and, when the door 10 moves downwards, the stepped portion 22 is moved downwards.

Preferably, the operation controller is operated such that when the slag discharge outlet 1*a* is open, the stepped portion 22 is level with the support base portion 21.

The reason for this is to make it easy for the worker to conduct work of eliminating solidified slag when slag is solidified and to prevent slag from undesirably flowing outwards due to increased space between the door 10 and the stepped portion 22 when the slag discharge outlet 1*a* is open.

As shown in FIG. 7, preferably, the stepped portion 22 can be moved higher than the upper surface of the support base portion 21 so that removal of solidified slag (solidified slag) is facilitated.

In this case, the worker can easily eliminate, using a tool, the solidified slag that is detached from the upper surface of the door support 20.

Meanwhile, preferably, embodiments of the present invention further include a solidified slag detaching unit 60 which removes solidified slag that has been adhered to the guide rail 40.

Slag that is adhered to the guide rails 40 while being discharged from the electric furnace 1 through the slag discharge outlet 1*a* is solidified and thus impedes the up-and-down movement of the door 10. In a serious case, the solidified slag may make the up-and-down movement of the door 10 impossible. Therefore, before the slag discharge outlet 1*a* is closed again, the solidified slag must be eliminated.

When solidified slag is formed by solidification of slag, because the solidified slag is also closely adhered to the guide rails 40, it is difficult for the worker to remove the solidified slag from the guide rails 40.

In embodiments of the present invention, the solidified slag detaching unit 60 detaches the solidified slag from the guide rail 40, thus making it easy for the worker to remove the solidified slag from the guide rail 40.

The solidified slag detaching unit 60 may comprise a rail vibrating motor 61 which is connected to the guide rail 40 and vibrates the guide rail 40.

In other words, the rail vibrating motor 61 vibrates the guide rail 40 so that slag solidified on the surface of the guide rail 40, that is, solidified slag formed on the guide rail 40, is detached from the guide rail 40.

Figure 8:
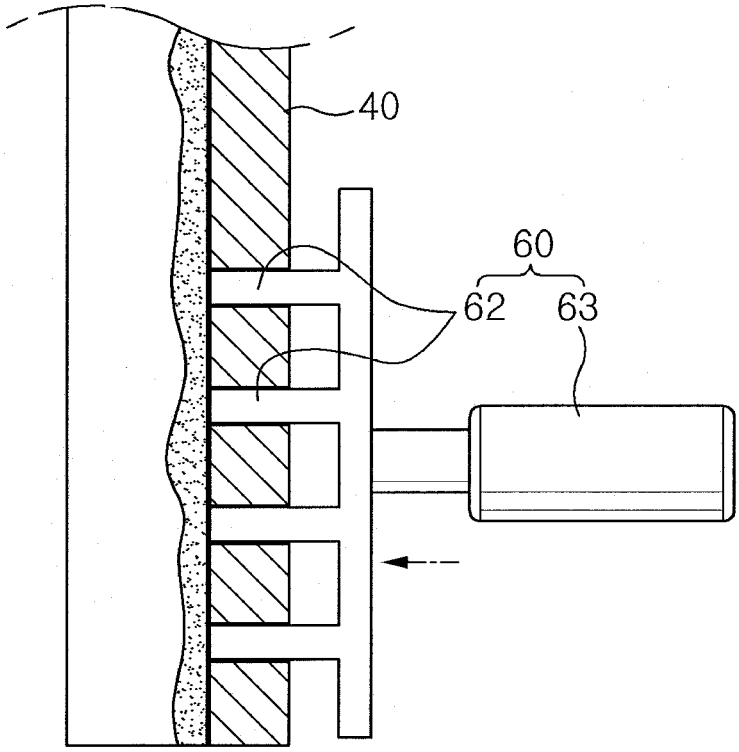
FIG. 8 is a view showing the operation of another embodiment of the present invention.

In another embodiment, as shown in FIG. 8, the solidified slag detaching unit 60 may include a plurality of solidified slag removal pins 62 which are movably placed through the guide rail 40, and a pin drive device 63 which moves the solidified slag removal pins 62 so that the solidified slag removal pins 62 protrude from a guide surface of the guide rail 40 which guides the door 10.

For example, a hydraulic cylinder is used as the pin drive device 63. In addition to this, the pin drive device 63 may comprise any other structure, so long as it can move the solidified slag removal pins 62 in the lateral direction.

In this embodiment, the solidified slag removal pins 62 are extracted from the guide surface of the guide rail 40; in other words, from the surface of the guide rail 40 that is connected to the door 10 to guide the movement of the door 10, by the operation of the pin drive device 63, that is, the hydraulic cylinder. Thereby, the solidified slag solidified on the guide surface of the guide rail 40 can be detached therefrom.

As described above, embodiments of the present invention prevent slag from leaking out of the electric furnace 1 through a gap formed between the door support 20 and the door 10 which opens or closes the slag discharge outlet 1*a*. Furthermore, solidified slag, that is, base metal, formed between the door 10 and the door support 20 can be easily removed so that the sealed state of the slag discharge outlet 1*a* can be reliably maintained while the door 10 is in the closed state.

Although the embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An electric furnace apparatus, comprising:

a door movable between an open position and a closed position, configured to open a slag discharge outlet in the open position and further configured to close the slag discharge outlet in the closed position;

a door support supporting the door located in the closed position, wherein the door support comprises a recessed portion configured to receive an end portion of the door, the end portion having a bottom surface and a side surface, wherein the recessed portion comprises first and second surfaces, which oppose the bottom and side surfaces of the door in the closed position, respectively; and a slag remover configured to remove solidified slag in the recessed portion.

2. The apparatus of claim 1, wherein the door support comprises a passage configured to circulate a coolant to cool the first surface of the recessed portion such that molten slag permeating between the door and the door support is solidified.

3. The apparatus of claim 1, wherein the door comprises a passage configured to circulate a coolant to cool the end portion of the door such that molten slag permeating between the door and the door support is solidified.

4. The apparatus of claim 1, wherein the slag remover comprises a shaker configured to shake the door support to separate the solidified slag in the recessed portion from the door support.

5. The apparatus of claim 1, wherein the slag remover comprises a plurality of push rods configured to push the solidified slag formed over the first surface of the recessed portion to separate the solidified slag in the guide groove from the door support.

6. The apparatus of claim 1, wherein the first surface is movable upwardly and configured to move upwardly when the door is open.

7. The apparatus of claim 1, wherein the slag remover comprises an actuator configured to move the first surface upwardly so as to facilitate separating the solidified slag from the door support.

8. The apparatus of claim 1, further comprising a guide rail configured to guide the movement of the door between the open position and the closed position, wherein one of the guide rail and the door comprises a guide groove and the other of the guide rail and the door comprises a guide protrusion engaged with the guide groove.

9. The apparatus of claim 8, wherein the door comprises the guide protrusion, wherein the door comprises an extension extending from the guide protrusion and inserted in the guide groove so as to inhibit the molten fluid from flowing into the guide groove.

10. The apparatus of claim 8, further comprising a coolant passage configured to circulate a coolant to cool the guide groove such that molten slag permeating between the door and the guide rail is solidified.

11. The apparatus of claim 8, further comprising a second slag remover configured to remove solidified slag in the guide groove.

12. The apparatus of claim 11, wherein the guide rail comprises the guide groove, wherein the second slag remover comprises a shaker configured to shake the guide rail to separate the solidified slag in the guide groove from the guide rail.

13. The apparatus of claim 11, wherein the guide rail comprises the guide groove, wherein the second slag remover comprises a plurality of push rods configured to push the solidified slag in the guide groove to separate the solidified slag in the guide groove from the guide rail.

* * * * *